United States Patent [19]

Nelson

[11] 4,193,625

[45] Mar. 18, 1980

[54] BALL RETRIEVING AND STORAGE BAG

[76] Inventor: Ned H. Nelson, 9829 NE. 5th, Bellevue, Wash. 98004

[21] Appl. No.: 859,383

[22] Filed: Dec. 12, 1977

[51] Int. Cl.[2] ..... A63B 57/00

[52] U.S. Cl. ..... 294/19 A

[58] Field of Search ..... 294/19 A, 19 R, 1 R, 294/99 R, 110 A, 113, 114; 273/32 F, 162 E, 163 R, 164; 214/356

[56] References Cited

U.S. PATENT DOCUMENTS

| | | | |
|---|---|---|---|
| 3,371,950 | 3/1968 | Stap | 294/19 A |
| 3,889,996 | 6/1975 | Campbell | 294/19 A |
| 3,926,465 | 12/1975 | Hoagland et al. | 294/19 A |
| 3,982,781 | 9/1976 | Tucker et al. | 294/19 A |

*Primary Examiner*—James B. Marbert

*Attorney, Agent, or Firm*—Thomas W. Secrest

[57] ABSTRACT

This invention is directed to an apparatus to assist in retrieving tennis balls and in storing tennis balls. The apparatus comprises a bottom frame through which a tennis ball may pass upwardly when the bottom frame is positioned over the tennis ball and pressed firmly to the ground and which frame prevents the tennis ball passing downwardly and out of the frame by means of gravitational force. There is positioned above the frame a storage bag for storing tennis balls.

8 Claims, 8 Drawing Figures

BALL RETRIEVING AND STORAGE BAG

There is a co-pending application entitled "A BALL RETRIEVING AND STORAGE BAG," filing date of July 25, 1977, Ser. No. 818,975; and, a patent application with co-inventor MARVIN L. BEHAR entitled "A BALL RETRIEVING AND STORAGE BAG," filing date of Apr. 28, 1978, Ser. No. 900,887.

BACKGROUND OF THE INVENTION

This invention relates to an apparatus which allows a user of tennis balls to pick up numerous tennis balls from the ground in one operation. Then the user can store and carry the tennis balls in a convenient container without bending or stooping to pick up the balls by hand. As an illustration of the usefulness of this invention a tennis player wants to improve his serve by practicing, by himself, the serving of the tennis ball. The player goes to the tennis court and may serve ten or twenty or thirty tennis balls. There comes a time when the player must pickup the balls to once again practice the serve. It is inconvenient to the player and also interrupts the concentration of the player to bend over and pickup two or three balls and then serve these balls; and then repeat the process until all of the balls on one side of the net have been served over to the other side of the net. With this invention it is possible to pickup and store all of the balls at a location convenient to the player. There is a saving of time and there is a convenience to the tennis player as well as less frustration because the concentration of the tennis player is not interrupted.

At present, students and players of the game of tennis frequently use a large number of tennis balls when practicing and playing the game. A container is desirable to provide a means for collecting, storing and carrying a quantity of tennis balls. In addition to being useful on the tennis court the invention is useful in transporting the tennis balls and the tennis racket to and from the tennis court.

GENERAL DESCRIPTION OF THE INVENTION

This invention is a tennis ball retrieving and storage apparatus comprising, in its preferred embodiment, a generally rigid assembly of varying lengths and standard pipe fittings of polyvinyl chloride pipe and two resilient plastic members. The two resilient members are located parallel to each other within the open rectangular base frame of the apparatus with the distance between them being slightly less than the diameter of a tennis ball. When the resilient members and the base of the apparatus are placed over a tennis ball or balls, and a downward force is exerted upon the handle of the apparatus, the resilient members are forced apart from each other sufficiently to admit the tennis balls upwardly into the storage container portion of the apparatus. Also, the tennis balls may be compressed to be able to pass between the resilient members. After the passage of tennis balls between the resilient members, the members immediately resume their original parallel position and thus prevent the tennis balls from escaping through the generally open bottom frame of the apparatus by gravitational force. A length of cloth may be lashed to the rectangular periphery of the base and the cloth may extend upwardly from the base and around the vertical legs of the handle to define an enclosure for containing the tennis balls within the apparatus. Straps may be placed around one or both of the vertical legs of the handle to secure tennis rackets thereto, providing a means of storing and carrying tennis rackets as well as tennis balls.

A modification is that the two parallel members within the bottom frame of the apparatus may be rigid.

As a tennis ball is compressed between the rigid members, they rotate and thus assist the passage of the tennis ball upwardly between them into the storage container.

THE DRAWINGS

Figure 4:
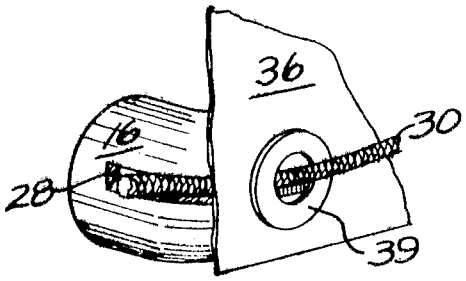
Figure 5:
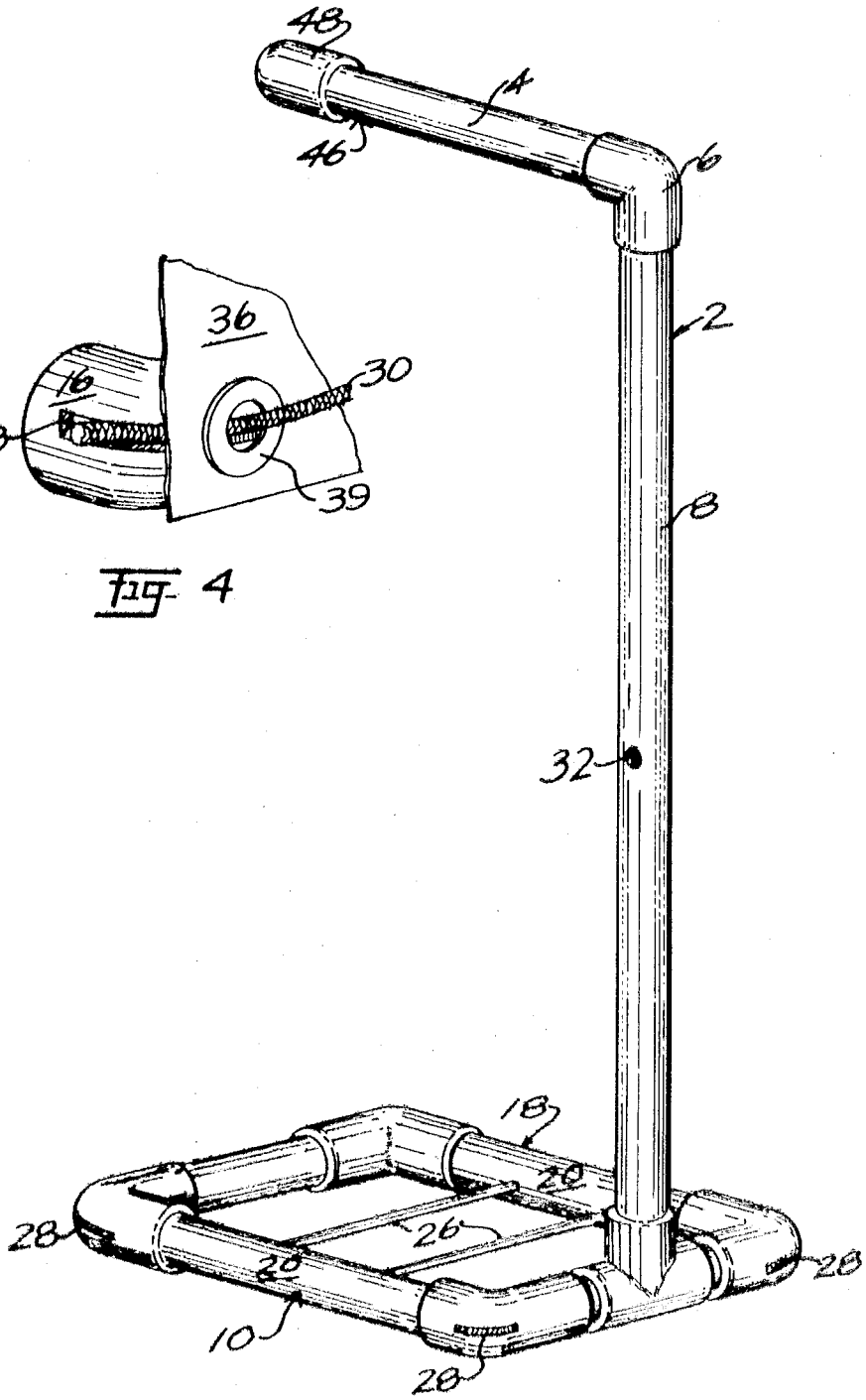
Figure 6:
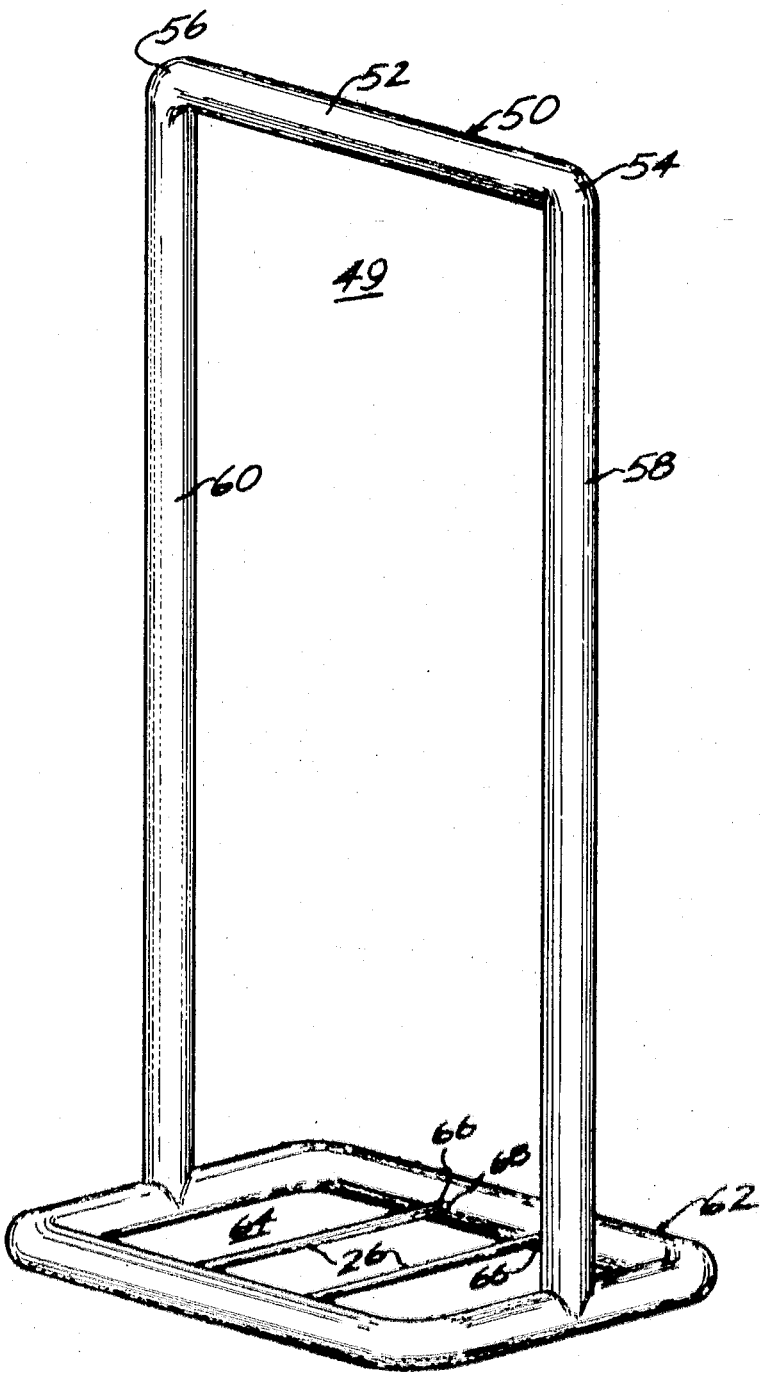
Figure 7:
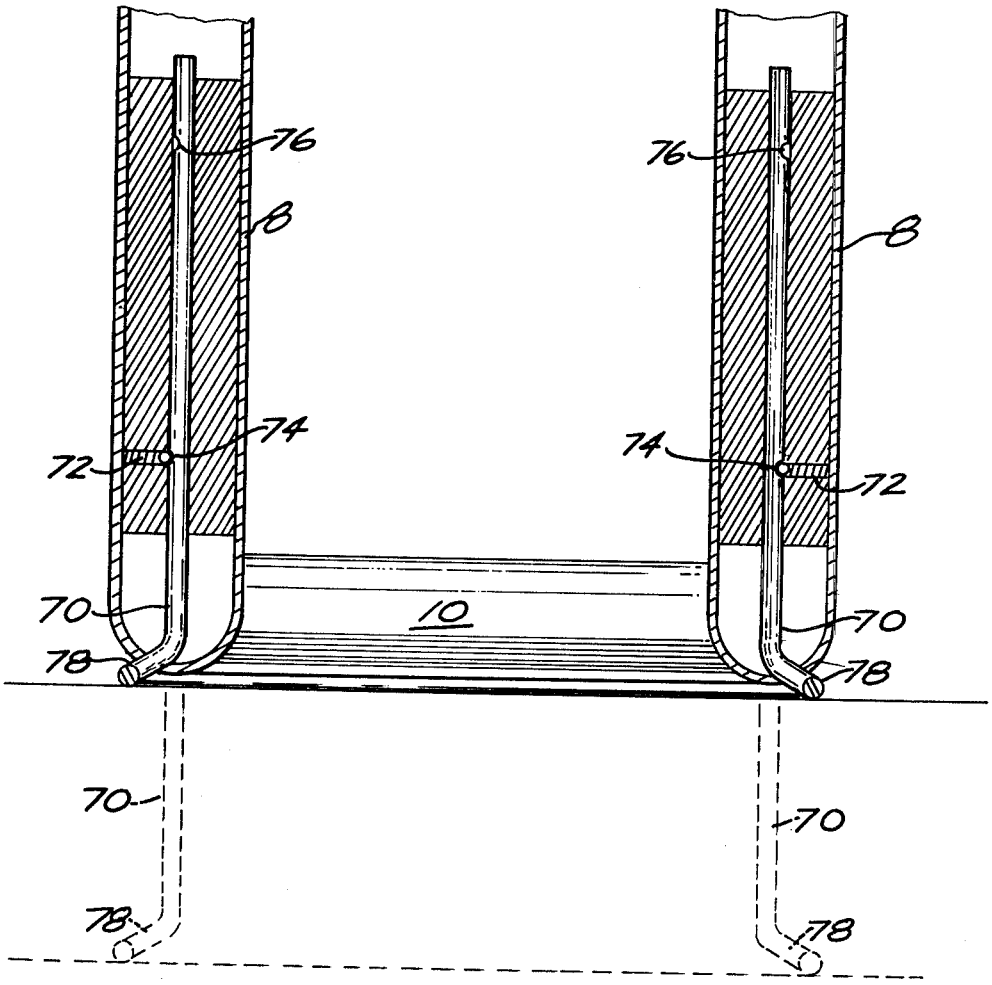
Figure 8:
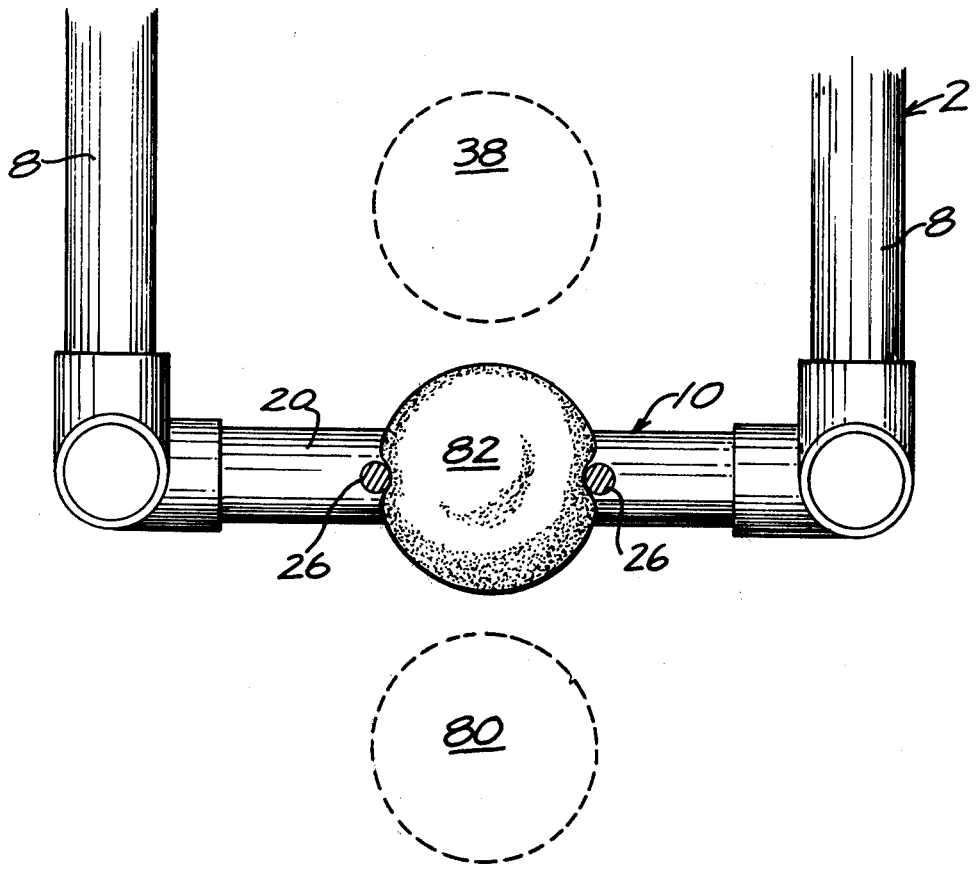

FIG. 4 on an enlarged scale, is an isometric view of a corner of the bottom frame of the invention and a fragmentary portion of the container fabric showing the manner of securing the container fabric to the periphery of the bottom frame or the base;

FIG. 5 is an isometric view of an alternative embodiment of the invention having a handle attached to a single upright leg;

FIG. 6 is an isometric view of another embodiment of the invention constructed of tubing or pipe bent to the desired configuration and with soldered, brazed or welded joints;

FIG. 7 is a sectional elevational view of another embodiment of the invention having vertically movable stilts within the upright legs to raise the height of the handle above the ground for the convenience of users of the apparatus who may have difficulty in grasping the handle of the apparatus when the bottom frame rests upon the ground or the surface of the tennis court; and, FIG. 8 on an enlarged scale, is a fragmentary view of the base and illustrates the compressing of the tennis ball between the two resilient members in passing into the container.

DETAILED DESCRIPTION OF THE INVENTION

Figure 1:
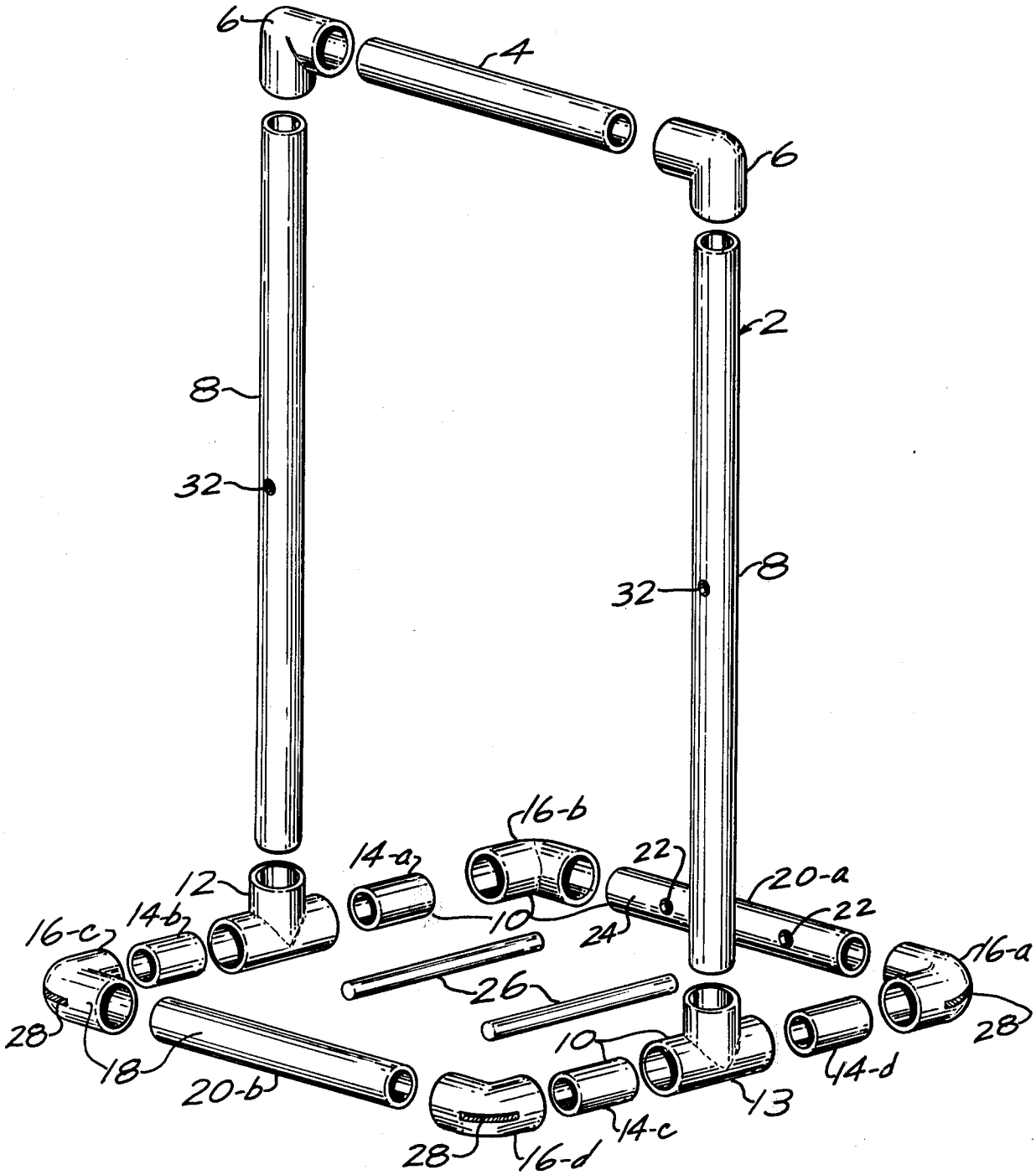
FIG. 1 is an isometric exploded view of the frame, upright legs and handle of the apparatus showing its components is disassembly, but in their relative positions for assembly.
Figure 2:
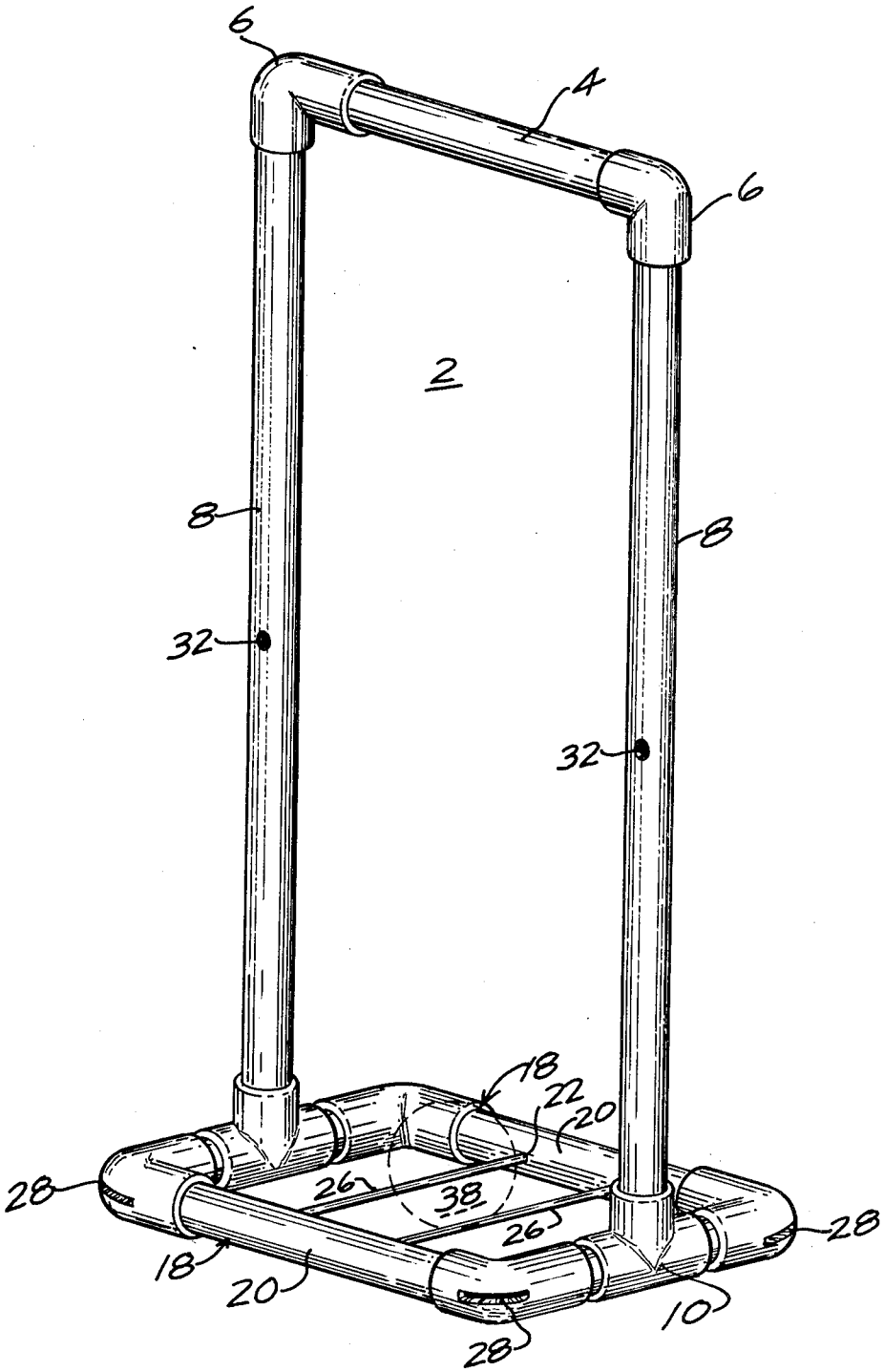
FIG. 2 is an isometric view of the frame, upright legs and handle of the apparatus in its assembled configuration.

In FIGS. 1 and 2, it is seen that a tennis ball retrieval and storage apparatus 2 comprises a handle 4 connected by means of a pair of right angle elbows 6 to a pair of upright legs 8. The upright legs 8 are connected to the bottom frame 10 of the tennis ball retrieval and storage apparatus 2 by means of a pair of Tees 12 and 13. The Tee 13 may be considered as a first Tee and the Tee 12 may be considered as a second Tee. Tees 12 and 13 are connected to a plurality of right angle elbows 16, viz., 16-*a*, 16-*b*, 16-*c* and 16-*d*, by means of a plurality of nipples 14, viz., 14-*a*, 14-*b*, 14-*c* and 14-*d* by way of terminology a first elbow is 16-*a*; a second elbow is 16-*b*; a third elbow is 16-*c*; and, a fourth elbow is 16-*d*. Also, a first nipple is 14-*a*; a second nipple is 14-*b*; a third nipple is 14-*c*; and, a fourth nipple is 14-*d*. The sides 18 of the bottom frame 10 comprise a pair of long pipes 20, viz., 20-*a* and 20-*b*, a first long pipe is 20-*a* and a second long pipe is 20-*b*. Each long pipe 20 has a pair of holes 22 through its interior wall 24 to receive and locate in parallel relation, a pair of flexible rods 26.

It is seen also that the plurality of right angle elbows 16 each has a horizontal slot 28 in the outer wall of the right angle to receive and hold the container fabric lower lashing 30. It is further seen that each upright leg 8 is pierced by a hole 32 located near its mid-length and through which hole is passed a container top lashing 34.

In FIG. 2 it is seen a tennis ball 38, illustrated in phantom, having passed upwardly between the flexible rods 26 which are maintained in parallel relationship at a spacing slightly less than the diameter if the tennis ball 38 by means of the locating and retaining holes 22 in the long pipes 20 comprising the sides 18 of the bottom frame 10.

In FIG. 8 there is illustrated a tennis ball 80, in phantom, below the bottom frame 10. In solid line there is illustrated a tennis ball 82 being compressed and passing between the two resilient members 26. Also, there is illustrated the tennis ball 38, in phantom, above the bottom frame 10 and in the container or storage apparatus 2.

Figure 3:
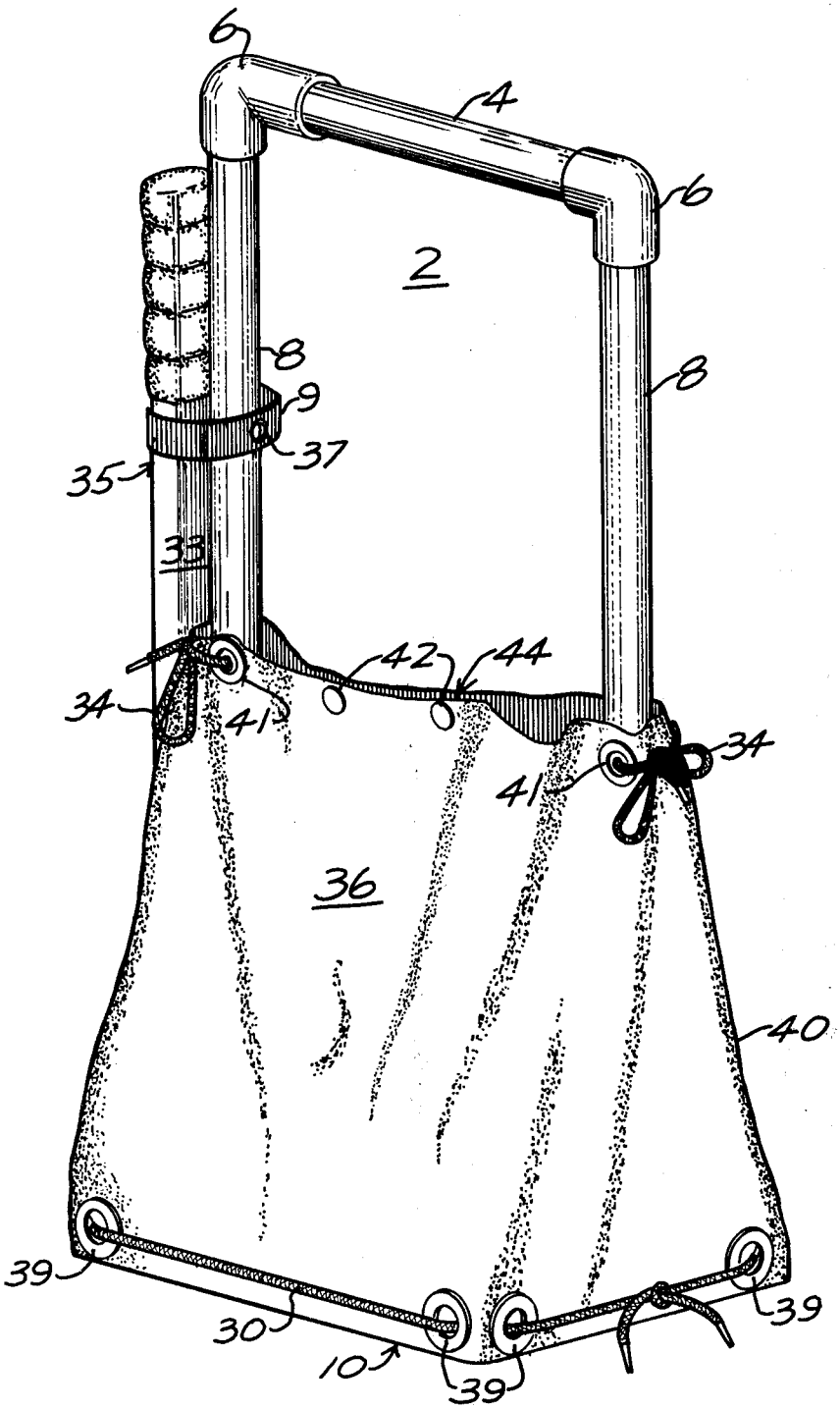
FIG. 3 is an isometric view of the assembled apparatus showing the cloth lashed to the periphery of the rectangular base and encompassing the upright legs to approximately their mid height, and also illustrating a tennis racket strapped to an upright leg.

In FIG. 3 it is seen that the container portion 36 of the tennis ball retrieval and storage apparatus 2 comprises a length of fabric 40 having a plurality of eight grommets 39 at its lower corners to permit it to be lashed by means of the lashing 30 to the bottom frame 10. Also, at the upper corners there are four grommets 41 to permit the lashings 34 to attach the upper part of the fabric to the upright legs 8 of the tennis ball retrieval and storage apparatus 2. The container fabric 40 may have a plurality of snap closures 42 located near its top 44 and along the upper edge.

A tennis racket 33 may be secured to an upright leg 8 for carrying with the storage apparatus 2 by a strap 9 attached to the upright leg 8 by a screw 37. The strap 9 encircles the upright leg 8 and the handle 35 of the tennis racket 33.

In FIG. 4 is seen in detail the method of securing and retaining the storage container cloth 36 to the bottom frame elbow 16 by means of the lashing cord 30, the grommet 38 in the container cloth 36 and the slot 28 in the right angle elbow 16. It is seen that the lashing cord 30 fits into the slot 28, and when the cord 30 is pulled tight the cord 30 is firmly positioned in the slot 28.

FIG. 5 shows an alternative embodiment of the invention having a single upright leg 8 to which is attached the handle 4 by means of the right angle elbow 6. The unsupported end 46 of the handle 4 is enclosed by a cap 48. In FIG. 5 it is seen that there is a hole 32 in the upright leg 8 for receiving a lashing 34.

In FIG. 6 is seen another embodiment of a frame 50 of a tennis ball retrieval and storage device 49 having a handle portion 52 bent at right angles at its ends 54 and 56 and two upright legs 58 and 60. Said upright legs 58 and 60 are joined by means of solder, brazing or weldment to the generally rectangular tubular bottom frame 62. It is seen that the bottom frame 62 supports in parallel relation within its enclosed center space 64, a pair of flexible rods 26 whose ends 66 are located in a plurality of holes 68. Or, the storage device 49 may be a unitary molded plastic frame of a suitable commercial plastic such as polyvinyl chloride.

In FIG. 7 it is seen that the telescoping legs 70 are retained within the upright legs 8 in their retracted position by means of pivotally mounted pawl 72 which engages recess 74, in the middle of said telescoping leg 70. When the telescoping legs 70 are extended to their exterior position as shown in phantom line in FIG. 7, said telescoping legs 70 are retained in said extended position by means of the locking pawl 72 engaged in the recesses 76 near the end of said legs.

The use of the tennis ball retrieval and storage apparatus is understood best by reference to FIG. 2. The user places the bottom frame 10 of the tennis ball retrieval and storage apparatus 2 over one or more tennis balls 38 upon the ground. The space between the parallel flexible rods 26 and between each such rod 26 and the ends of the bottom frame 10 is slightly less than the diameter of a tennis ball 38. As the user exerts a downward force upon the handle 4 of the tennis ball retrieval and storage apparatus 2, the flexible rods 26 deflect momentarily and sufficiently, and said tennis ball 38 compresses momentarily and slightly (see FIG. 8) to allow the tennis ball 38 to slip between the flexible rods 26 or between a flexible rod 26 and one end of the bottom frame 10 to pass upward into the storage area 36 defined by the fabric 40 shown in FIG. 3. After passage of the tennis ball 38 into the storage container 36, the flexible rods 26 resume their original parallel position preventing tennis balls 38 from slipping downwardly through the bottom frame 10 by force of gravity.

An alternative embodiment of the tennis ball retrieving and storage device 2 is shown in FIG. 5. In this embodiment, one of the upright legs 8 has been eliminated. The unsupported end of 46 of the handle 4, therefore, terminates with a cap 48. In all other respects, this embodiment functions the same as the preferred embodiments shown in FIGS. 1, 2 and 3.

An alternate means of constructing the tennis ball retrieval and storage device 49 from metal pipe or tubing is shown in FIG. 6. The joints may be soldered, brazed or welded. Or, 49 may be a unitary plastic frame.

In FIG. 7 it is seen that for those users of the tennis ball retrieval and storage apparatus 2 who may find it difficult or inconvenient to bend to grasp the handle 4 of the apparatus 2 when the apparatus is being used as a tennis ball storage and carrying means, a pair of telescoping legs 70 contained within the upright legs 8 are provided as shown in FIG. 7. When the telescoping legs 70 are extended outwardly and downwardly from the upright legs 8, the legs 70 are retained in the extended position by means of locking pawls 72 and engaging recesses 76 in the upper part of said telescoping legs 70. In FIG. 7 it is seen that the height of the handle 4 is raised upwardly by the same distance the telescoping legs 70 are extended below the upright legs 8 and bottom frame 10 of the apparatus 2. The lower end of the leg 70 bends into an outwardly directed foot 78. In the lower part of the leg 70 is a recess 74 for receiving a locking pawl 72. In FIG. 7, in solid line, there is illustrated the legs 70 in a retracted position inside of the legs 30 so that the apparatus 2 can pickup the tennis balls 80, 82 and 38.

The distance between the center of the flexible rods 26 and the surface on which bottom frame 10 rests is less than the radius of the tennis ball so that the tennis ball can be forced through the bottom frame and into the container.

From the foregoing and having presented my invention, what I claim is:

1. An apparatus for retrieving and storing a tennis ball, said apparatus comprising:

a. a base comprising a frame;

b. a member in said frame;

c. the dimension between said frame and said member being less than the diameter of a tennis ball to prevent the tennis ball being pulled through said base by gravity;

d. said frame may be positioned over said tennis ball and then forced over said tennis ball so as to squeeze said tennis ball between said member and said frame and into said apparatus;

e. an enclosing means positioned above said frame and for storing said tennis ball;

f. a handle connecting with said frame;

g. said frame comprising a first, second, third and fourth right angle elbow, a first and a second Tee, a first and a second long pipe, a first, second, third and fourth nipple;

h. said first right angle elbow connecting with said first long pipe and said first long pipe connecting with said second right angle elbow and said second right elbow connecting with said first nipple and said first nipple connecting with said first Tee and said first Tee connecting with said second nipple and said second nipple connecting with said third right angle elbow and said third right angle elbow connecting with said second long pipe and said second long pipe connecting with said fourth right angle elbow and said fourth right angle elbow connecting with said third nipple and said third nipple connecting with said second Tee and said second Tee connecting with said fourth nipple and said fourth nipple connecting with said first right angle elbow to form a frame enclosing an open area;

i. a first member and a second member connecting with said first long pipe and said second long pipe; and, j. the distance between said members and the distance between said member and said Tee being less than the diameter of the tennis ball to prevent the tennis ball being pulled through said base by gravity.

2. An apparatus according to claim 1 and comprising:

a. said member being flexible, resilient, adaptable and deformable to allow said tennis ball to pass between said member and said frame.

3. An apparatus according to claim 2 and comprising:

a. said member being positioned in said frame and being rotatable in said frame.

4. An apparatus according to claim 3 and comprising:

a. said frame circumscribing an opening.

5. An apparatus according to claim 1 and comprising:

a. said first Tee connecting with a first upright leg;

b. said second Tee connecting with a second upright leg;

c. a fifth right angle elbow connecting with said first upright leg;

d. a sixth right angle elbow connecting with said second upright leg;

e. a third long pipe connecting with said fifth right angle elbow and with said sixth right angle elbow to form a handle.

6. An apparatus according to claim 5 and comprising:

a. each of said first, second, third and fourth right angle elbows in said frame having an exterior slot;

b. said enclosing means comprising a fastening means for fitting in each of said slots in said right angle elbow;

c. a passageway in each of said upright legs; and, d. a means connecting said enclosing means to said passage way and to each of said upright legs to form a bag for retaining said tennis balls.

7. A method for assembling an apparatus for retrieving and storing a tennis ball, said method comprising:

a. assembling a plurality of plastic plumbing pieces to form a frame comprising right angle elbows, and a Tee to form a frame;

b. positioning a member in said frame with the distance between said member and the closest side of said frame being somewhat less than the diameter of the tennis ball;

c. positioning an upright leg on said Tee;

d. on the upper part of said upright leg positioning a right elbow;

e. positioning a pipe in said upright elbow to function as a handle; and, f. positioning an enclosing means on said upright leg and said frame to store the tennis ball.

8. A method for assembling an apparatus according to claim 7 and comprising:

a. said Tee being a first Tee;

b. a second Tee;

c. said first Tee and said second Tee forming part of said frame;

d. said upright leg being a first upright leg;

e. a second upright leg on said second Tee;

f. a second right angle elbow on said second upright leg;

g. said pipe connecting with said second right angle elbow; and, h. positioning said enclosing means on said upright legs and said frame to store said tennis ball.

* * * * *